US006769474B2

(12) United States Patent
Engels et al.

(10) Patent No.: US 6,769,474 B2
(45) Date of Patent: Aug. 3, 2004

(54) CASTING DIE FOR THE PRODUCTION OF A CYLINDER BLOCK/CRANKCASE

(75) Inventors: Hartmut Engels, Wolfschlugen (DE); Klaus Land, Schlierbach (DE); Peter Lingl, Esslingen (DE); Franz Rueckert, Ostfildern (DE); Helmut Schaefer, Kernen (DE); Peter Stocker, Sulzbach (DE)

(73) Assignee: DaimlerChrysler AG, Stuttgart (DE)

( * ) Notice: Subject to any disclaimer, the term of this patent is extended or adjusted under 35 U.S.C. 154(b) by 73 days.

(21) Appl. No.: 10/285,125

(22) Filed: Oct. 31, 2002

(65) Prior Publication Data

US 2003/0085018 A1 May 8, 2003

(30) Foreign Application Priority Data

Oct. 31, 2001 (DE) ..... 101 53 721

(51) Int. Cl.[7] ..... B22D 17/04
(52) U.S. Cl. ..... 164/312; 164/332
(58) Field of Search ..... 164/312, 112, 164/332

(56) References Cited

U.S. PATENT DOCUMENTS 4,905,642 A 3/1990 Suzuki et al.
5,121,786 A * 6/1992 Kawase et al. ..... 164/98
5,320,158 A * 6/1994 Helgesen ..... 164/76.1
5,983,975 A * 11/1999 Nilsson ..... 164/98
6,250,368 B1 * 6/2001 Ushio et al. ..... 164/312
6,286,210 B1 * 9/2001 Ruckert et al. ..... 29/888.061
6,363,995 B1 4/2002 Baranzke
6,516,869 B2 * 2/2003 Crivellone et al. ..... 164/340
6,527,040 B2 * 3/2003 Singer et al. ..... 164/137

FOREIGN PATENT DOCUMENTS

| | | |
|---|---|---|
| DE | 35 39 674 | 1/1987 |
| DE | 44 38 550 | 5/1996 |
| DE | 44 42 453 | 5/1996 |
| DE | 198 53 803 | 3/2000 |

* cited by examiner

*Primary Examiner*—Kiley Stoner
*Assistant Examiner*—Len Tran
(74) *Attorney, Agent, or Firm*—Kenyon & Kenyon

(57) ABSTRACT

A casting die for the production of a cylinder block/crankcase of an internal combustion engine includes at least one sleeve, which may be moved relative to its axis and is fitted in each case with a cylinder liner, the sleeve keeping open the cylinder bore of the cylinder block/crankcase and extending from a wall on the cylinder-head side of the die to a wall on the crankshaft side of the casting die. The cylinder liner ends at least 3 mm before the wall on the cylinder-head side of the casting die, and the cylinder liner is held at a distance from the wall on the cylinder-head side of the casting die by a spacer.

16 Claims, 3 Drawing Sheets

CASTING DIE FOR THE PRODUCTION OF A CYLINDER BLOCK/CRANKCASE

CROSS-REFERENCE TO RELATED APPLICATIONS

The present application claims priority to Application No. 101 53 721.2, filed in the Federal Republic of Germany on Oct. 31, 2002, which is expressly incorporated herein in its entirety by reference thereto.

FIELD OF THE INVENTION

The present invention relates to a casting die.

BACKGROUND INFORMATION

To save weight, cylinder block/crankcase units are increasingly being manufactured from aluminum alloys by a variety of casting methods, preferably die-casting. Since aluminum alloys, which are good for casting, often do not meet the tribological requirements along the bearing surfaces of the cylinders, measures are taken to improve the properties of the material in these areas. One of these measures is the casting in of cylinder liners.

German Published Patent Application No. 44 38 550 describes a crankcase with cylinder liners made of hypereutectic aluminum-silicon alloys. The alloys described are particularly wear-resistant due to their high silicon content. Moreover, cylinder liners of this kind have a low relative density and—a particular advantage in comparison with cylinder liners based on iron—their thermal expansion coefficient is closer to that of the aluminum casting alloy than the expansion coefficient of iron.

Irrespective of the type of liners, bonding between the solidified casting metal (surrounding cast metal) and the cylinder liner is often inadequate. This results in gaps, which hinder heat transfer between the cylinder liner and the surrounding cast metal. In many cases, bonding between the liner and the surrounding cast metal is better toward the bottom of the liner, toward a crankshaft space, than toward the top, close to the cylinder head. However, it is precisely in the vicinity of the cylinder head that the thermal and mechanical loads on the cylinder liner are greatest. In the case of conventional engines, the slight bonding between the cylinder liner and the surrounding cast metal does not result in any functional disadvantage. In the case of modern engines, which feature very high-pressure forced induction, improved bonding between the liner and the surrounding cast metal may be necessary.

It is an object of the present invention to improve the bonding between a cylinder liner and the surrounding cast metal in a cylinder block/crankcase, especially on the cylinder-head side.

SUMMARY

The above and other beneficial objects of the present invention are achieved by providing a casting die as described herein.

The casting die according to an example embodiment of the present invention corresponds to a conventional casting die (in particular a die-casting die) for cylinder block/crankcase units to the extent that it is constructed from at least two die parts which, when closed, form a die cavity in the form of the crankcase. For ejection of the cavities and the bore, the die generally has a plurality of slides. To produce the cylinder bores, the casting die includes cylindrical sleeves. The sleeves may be part of a slide (sleeve slide, in the case of V-engines, for example) or may be secured rigidly in the die cavity (in the case of in-line engines, for example). The casting die is generally a die-casting die but other casting methods, e.g., methods similar to die casting, may be employed in accordance with the present invention.

The sleeves extend through the casting die from a wall on the cylinder-head side to a wall on the crankshaft side (crank space slide). The wall on the cylinder-head side of the casting die represents the surface of the subsequent crankcase on which the cylinder head is mounted after the machining of the parting plane of the cylinder head.

Cylinder liners are placed on the sleeves and subsequently at least partially form the bearing surfaces of the cylinders. The cylinder liners are fixed on the sleeve so that the cylinder liner ends, e.g., at least 3 mm before the wall on the cylinder-head side. The cylinder liner is held at least this distance by a spacer in the casting die.

One advantage of this arrangement may be that a melt of a casting metal (e.g., an aluminum alloy but also a magnesium alloy) may flow past an upper edge of the cylinder lining during filling and overflows the latter. Accordingly, the melt has a relative velocity with respect to the upper edge of the liner, contributing to a surface layer on the liner consisting essentially of an oxide skin being torn open and removed.

The oxide skin, which occurs on any light-alloy surface and thus also occurs on the cylinder liners, which may contain aluminum, prevents optimum joining of the solidified casting metal (surrounding cast metal) and the cylinder liner. Once this oxide skin (which may also contain other, organic impurities, e.g., soot, dust, residues of the die release agent, etc.) has been removed, the melt may locally melt the surface of the liner and join cohesively to it. A cohesive joint between the cylinder liner and the surrounding cast metal may be advantageous particularly in the region of the liner close to the cylinder head since it is here that the highest pressures and thus the highest mechanical loading may act on the liner. The casting die according to the present invention may result in a cylinder block/crankcase which may withstand higher pressures and thus may allow a higher engine power.

The spacer may be in each case mounted on the sleeve on which the cylinder liner is placed. The spacer on the sleeve may be in the form of an offset. The offset extends radially around the sleeve and the upper edge of the liner rests at least partially on the offset.

The offset may be interrupted one or more times as it extends around. This also includes an offset that is in the form of a single nose or of the plurality of noses.

By its very nature, the offset produces a recess in the cylinder track in the cast crankcase above the cylinder liner. Where the overcast region above the cylinder liner is retained when the engine is assembled, it is possible to configure the offset with a limited radial depth. The radial depth of the offset may be less than the radial removal of material during the finish machining of the bearing surface of the cylinder.

The spacer may also be part of the cylinder liner, e.g., in the form of pinnacles or peaks, e.g., through an encircling offset on an upper edge of the cylinder liner. The spacer may also be formed by an additionally inserted distance ring.

Above the respective cylinder liner, the casting die may have an opening leading to a cavity, into which melt may flow off. The effect of this arrangement may be that the melt has a relative velocity with respect to the liner in the upper region of the liner since it may flow off into the cavity. The kinetic energy of the moving melt may break up the oxide skin on the liner.

The cavity may be connected to the opening by a narrow passage, which may be cut off with little effort after the solidification of the component. The cavity and the passage may be arranged in a parting plane of the die to ensure a good casting ejection capability.

The cylinder liner may be composed of a hypereutectic aluminum-silicon alloy. Compared with aluminum casting alloys, such alloys may have improved wear resistance and may be distinguished by their low relative density and similar thermal expansion coefficients to those of the aluminum casting alloy. However, all materials with good wear characteristics may be suitable as a material for cylinder liners, including, e.g., ferrous materials.

Example embodiments of the present invention are explained below with reference to the figures.

DETAILED DESCRIPTION

Figure 1:
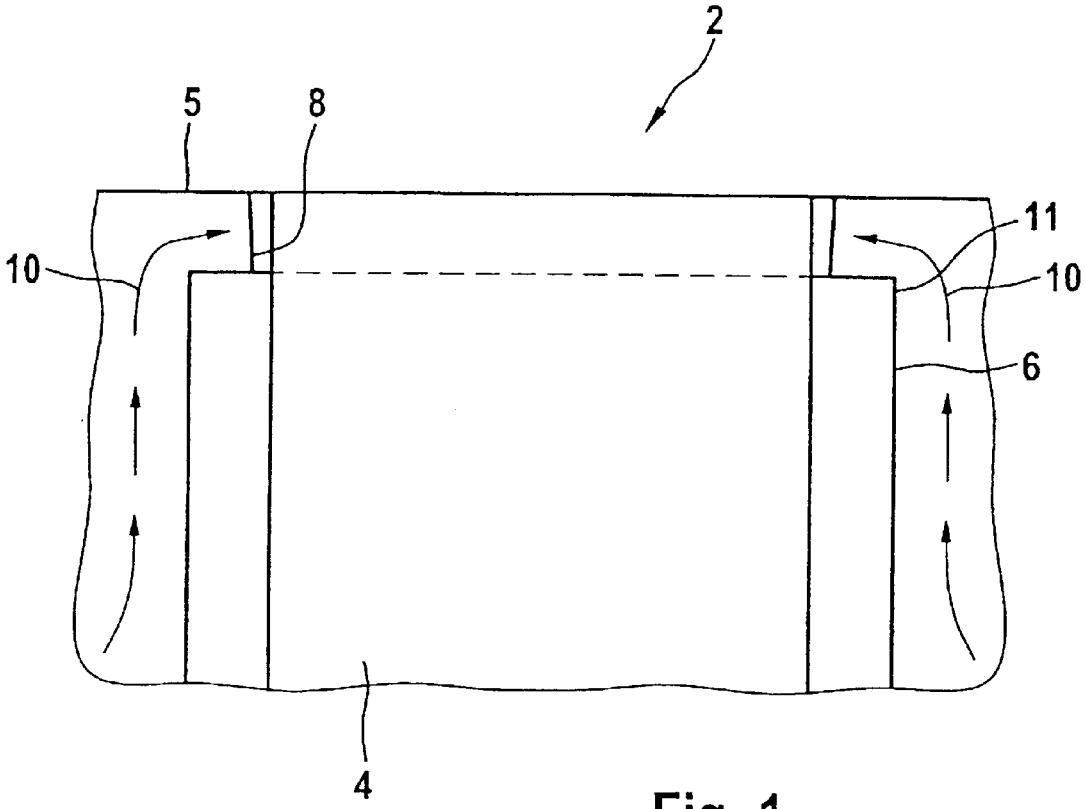
FIG. 1 is a fragmentary view of a casting die for a cylinder block/crankcase with a sleeve and a cylinder liner with an all-round offset on the sleeve.

The fragmentary view, illustrated in FIG. 1, of a casting die 2 according to the present invention includes a sleeve 4, which extends from a wall 5 on the cylinder-head side of the casting die 2 to a wall on the crankcase side of the casting die 2. A cylinder liner 6 is placed on the sleeve 4 and held at a distance from the die wall 5 by a spacer in the form of an all-round offset 8. Normally, a cylinder block/crankcase has a plurality of cylinder bores, and the casting die thus has a plurality of sleeves, each with a cylinder liner.

The flow 10 of molten casting metal is such that it overflows an upper edge 11 of the cylinder liner 6. The speed of the flow 10 of molten metal is so high in the region 11 that an oxide skin is split open. Due to the influence of the molten metal, the surface of the cylinder liner melts, with the result that, when the molten metal has solidified, there is a cohesive joint between the cylinder liner 6 and the surrounding cast metal.

The distance between the upper edge 11 of the cylinder liner 6 and the die wall 5, which is determined by the offset 8 (or offset 9 in FIG. 2), is at least 3 mm. This minimum distance may be required to ensure a sufficient rate of flow in this region. In practice, a distance of between 4 mm and 8 mm may be provided. In principle, the flow behavior of the molten metal in this region may be improved by a larger distance if the overflow is then removed by machining, this means a continuous increase in the outlay on machining as the distance increases.

The crankcase removed from the casting die 2 has a raised portion due to the surrounding cast metal in the region of the upper edge 11 of the cylinder liner. This surrounding cast metal may be removed by machining, giving a flat surface for the mounting of a cylinder head. The surrounding cast metal of the at least one cylinder liner may be configured so that a continuous flat surface for the mounting of the cylinder head is formed. This surface may merely be finely machined in an appropriate manner, it being possible to dispense with removal by machining up to the cylinder liner if the other design characteristics of the crankcase allow this.

If the option of leaving the surrounding cast metal above the cylinder liner is chosen, account may be taken of the fact that the offset 8 and offset 9 (FIG. 2) project radially beyond the sleeve only to the extent that they are within the machining tolerance of the bearing surface of the cylinder. During the machining of the crankcase, up to 3 mm of the bearing surface of the cylinder is removed radially. In all cases, care may be taken that the offsets 8 and 9 are capable of being removed from the die, as indicated in FIGS. 1 and 2 by casting-ejection bevels.

Figure 2:
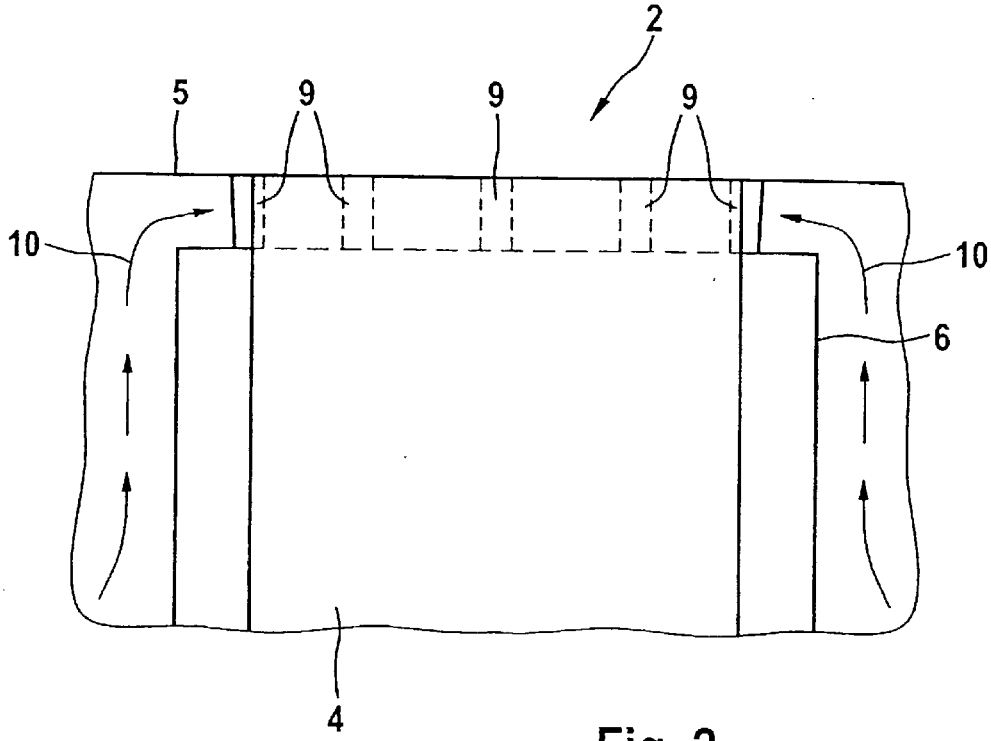
FIG. 2 is a fragmentary view of a casting die for a cylinder block/crankcase with a sleeve and a cylinder liner with a discontinuous offset on the sleeve.

The fragmentary view, illustrated in FIG. 2, of a cylinder block/crankcase differs from that in FIG. 1 only in that the radially encircling offset 9 is interrupted in several places. In FIG. 2, the offsets 9 are in the form of noses. In this configuration, at least one nose 9 is required.

Figure 3:
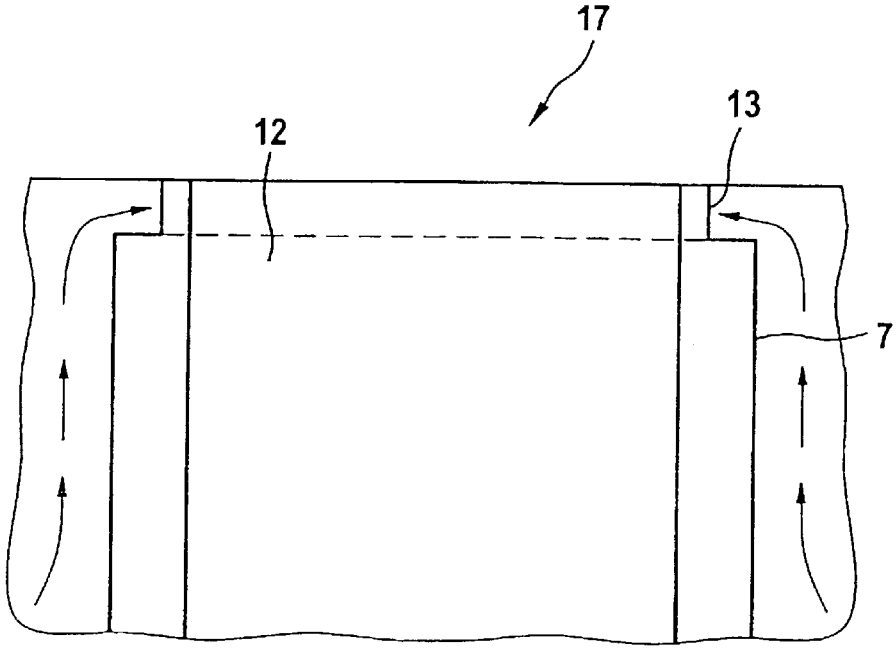
FIG. 3 is a fragmentary view of a casting die for a cylinder block/crankcase with a sleeve and a cylinder liner with an offset in the cylinder liner.

The spacer may also configured as an offset 13 in the cylinder liner 7 as illustrated in FIG. 3. In other respects the casting die 11 in FIG. 3 is constructed in the same manner as the die 2 illustrated FIGS. 1 and 2. The sleeve 12 does not have an offset.

Figure 4:
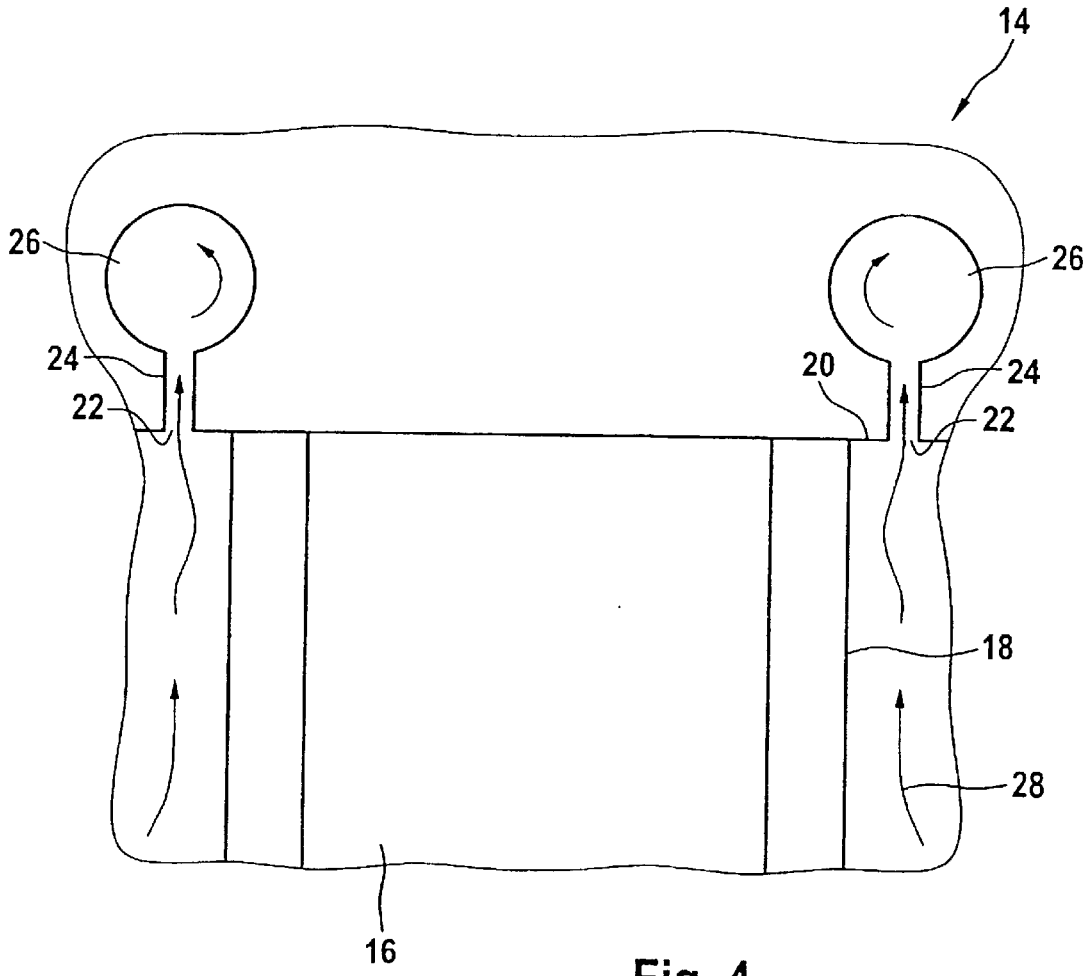
FIG. 4 is a fragmentary view of a casting die for a cylinder block/crankcase with a sleeve and a cylinder liner with a cavity for molten metal.

Another possible configuration of the present invention consists in an arrangement as illustrated in FIG. 4. In this case, the cylinder liner 18 rests directly on the wall 20 on the cylinder-head side of the casting die 14. In this arrangement, the relative velocity of the flow 28 of molten metal with respect to the upper region of the cylinder liner 18 is achieved by virtue of the fact that the molten metal 28 may flow off into a cavity 26 through an opening 22, via a passage 24. The effect as regards the splitting open of the surface oxide skin and the melting together of the surrounding cast metal and the cylinder liner corresponds to that described in relation to FIG. 1.

One aspect of this arrangement is that the overlapping regions formed on the cast crankcase by the passages 24 and of the cavities 26 may be simply cut off. On the other hand, removal of the filled cavities 26 from the casting die 14 may require a special design effort. A parting plane may be placed between two die halves so that it is in the plane of the drawing in FIG. 4. If this is not possible for design reasons, a recess, into which a lost core with a cavity similar to the cavity 26 is inserted, may made in the die wall 20. This core may be taken from the die with the casting and then removed.

What is claimed is:

1. A casting die for production of a cylinder block/crankcase of an internal combustion engine, comprising:

a wall on a cylinder-head side;

a wall on a crankshaft side;

at least one substantially cylindrical sleeve, each fitted with a cylindrical liner, the sleeve configured to keep open a cylinder bore of the cylinder block/crankcase and extending from the wall on the cylinder-head side to the wall on the crankshaft-side, the cylinder liner ending at least 3 mm before the wall on the cylinder-head side; and a spacer configured to hold the cylinder liner at a distance from the wall on the cylinder-head side.

2. The casting die according to claim 1, wherein the spacer is sunk into the sleeve.

3. The casting die according to claim 2, wherein the spacer includes an offset in the sleeve.

4. The casting die according to claim 3, wherein the offset extends around the sleeve.

5. The casting die according to claim 3, wherein the offset includes at least one interruption.

6. The casting die according to claim 3, wherein the offset projects to a machining depth of the cylinder bore.

7. The casting die according to claim 1, wherein the spacer is integrated into the cylinder liner.

8. The casting die according to claim 7, wherein the spacer includes an offset in the cylinder liner.

9. The casting die according to claim 1, wherein the spacer includes a distance ring.

10. The casting die according to claim 1, wherein the cylinder includes a hypereutectic aluminum-silicon alloy.

11. A casting die for production of a cylinder block/crankcase of an internal combustion engine, comprising:

a wall on a cylinder-head side;

a wall on a crankshaft side;

at least one substantially cylindrical sleeve, each fitted with a cylinder liner, the sleeve configured to keep open a cylinder bore of the cylinder block/crankcase and extending from the wall on the cylinder-head side to the wall on the crankshaft side;

at least one opening arranged above a respective cylinder liner in a region of the wall on the cylinder-head side; and at least one cavity arranged behind a respective opening.

12. The casting die according to claim 11, wherein the cylinder liner includes a hypereutectic aluminum-silicon alloy.

13. The casting die according to claim 11, wherein the cavity is configured to receive a flow of molten metal through the opening.

14. The casting die according to claim 11, wherein the cavity is fluidly connected to the opening through a passage in the wall on the cylinder-head side.

15. The casting die according to claim 11, wherein the casting die includes a parting plane through the cavity.

16. The casting die according to claim 11, wherein the cavity is arranged in a lost core disposed in a recess in the wall of the cylinder-head side.

* * * * *